United States Patent [19]

Pomper

[11] 4,238,666

[45] Dec. 9, 1980

[54] PORTABLE ELECTRIC SINGLE SERVICE BEVERAGE HEATING DEVICE

[76] Inventor: William R. Pomper, 207 Woodland Rd., Highland Park, Ill. 60035

[21] Appl. No.: 885,665

[22] Filed: Mar. 13, 1978

[51] Int. Cl.[3] ..... H05B 3/80; F24H 1/04

[52] U.S. Cl. ..... 219/318; 219/328; 219/337; 219/437; 219/523

[58] Field of Search ..... 219/523, 516, 316, 318, 219/335-337, 306, 296, 299, 275, 437, 308, 328

[56] References Cited

U.S. PATENT DOCUMENTS

| | | | |
|---|---|---|---|
| 985,344 | 2/1911 | Harvie et al. | 219/335 |
| 1,072,154 | 9/1913 | Ovington | 219/318X |
| 1,134,661 | 4/1915 | Allmayer | 219/523 X |
| 1,308,023 | 7/1919 | Abtmeyer | 219/523 X |
| 1,520,501 | 12/1924 | Kohn | 219/523 X |
| 1,599,912 | 9/1926 | Naujoks | 219/516 |
| 1,795,830 | 3/1931 | Brunhoff | 219/523 X |
| 2,274,383 | 2/1942 | Rush | 219/523 X |
| 2,429,303 | 10/1947 | Apatow | 219/523 |
| 2,554,745 | 5/1951 | Kapsch | 219/523 X |
| 2,691,089 | 10/1954 | Blais | 219/523 X |
| 2,727,979 | 12/1955 | Altosaar | 219/523 X |
| 2,801,324 | 7/1957 | Ware | 219/336 |
| 2,888,547 | 5/1959 | Saper | 219/523 |
| 3,020,385 | 2/1962 | Conlin et al. | 219/275 X |
| 3,206,589 | 9/1965 | Ryan et al. | 219/523 X |
| 3,319,049 | 5/1967 | Ulanet | 219/523 |
| 3,772,498 | 11/1973 | Temple | 219/336 |
| 3,864,544 | 2/1975 | Van Amerongen | 219/308 X |

FOREIGN PATENT DOCUMENTS

| | | | |
|---|---|---|---|
| 102210 | 12/1925 | Austria | 219/523 |
| 80191 | 2/1919 | Switzerland | 219/523 |
| 1019922 | 2/1966 | United Kingdom | 219/523 |

*Primary Examiner*—A. Bartis

*Attorney, Agent, or Firm*—Neuman, Williams, Anderson & Olson

[57] ABSTRACT

A portable liquid heating device includes a single service beverage container defining a cavity for a quantity of liquid and a removable electric heating unit disposed in the container to heat the liquid. The heating unit includes a top housing having a radial flange adapted to rest on the rim of the container in spaced relation thereto to vent the container. A rigid, apertured non-metallic shroud extends into the container from the top housing and terminates in an open free end. Spacer means engageable with the container walls surround the shroud means adjacent the flange to center the shroud in the container in spaced relation to the walls thereof. A cyclindrical thermostatically controlled electric heater, shorter than the shroud, extends downwardly from the top housing into the shroud in spaced relation thereto. The apertured shroud, heater and container walls are so spaced that a convective liquid flow is established upwardly between the shroud and heating element and downwardly between the shroud and container walls, thereby enhancing terminal distribution throughout the liquid and responsiveness of the heater thermostat while the liquid is being heated.

8 Claims, 5 Drawing Figures

FIG. 1
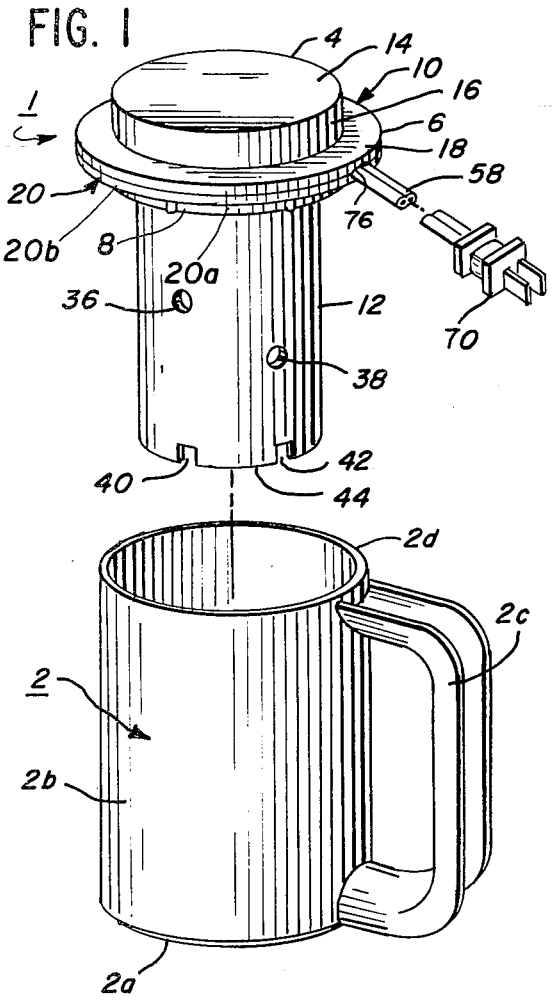
FIG. 2
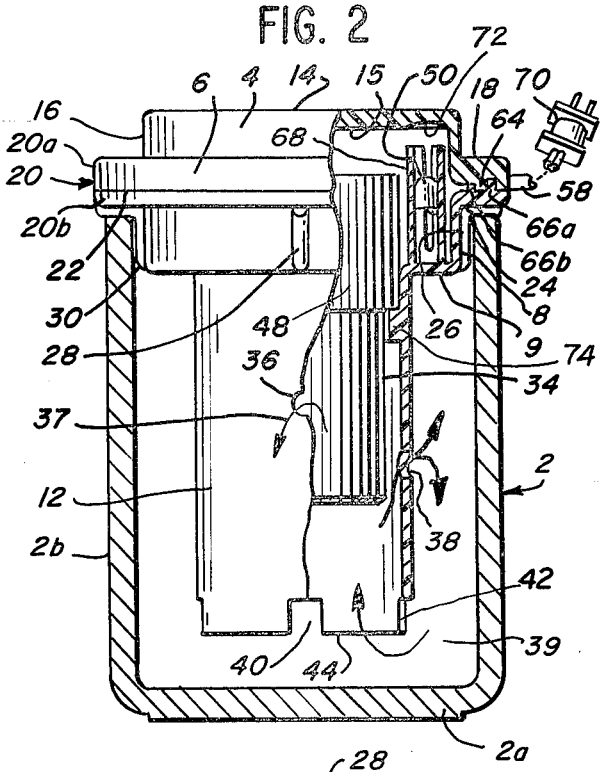
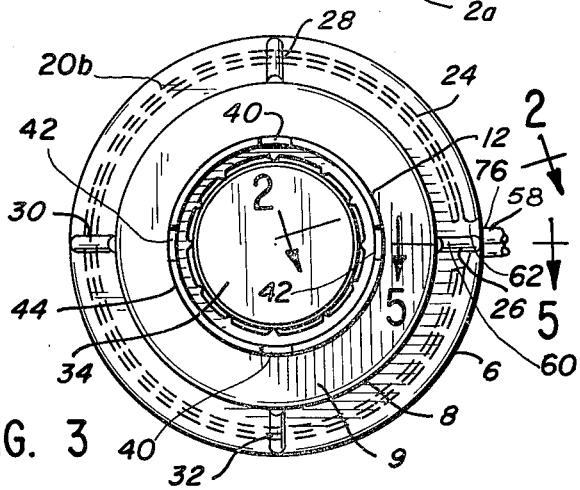
FIG. 3
FIG. 4
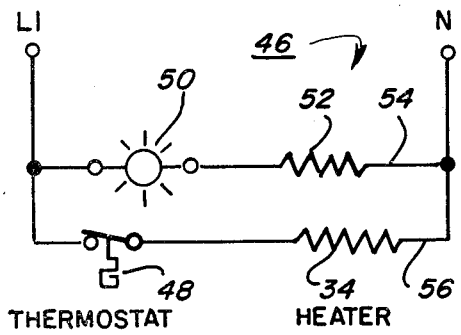
FIG. 5
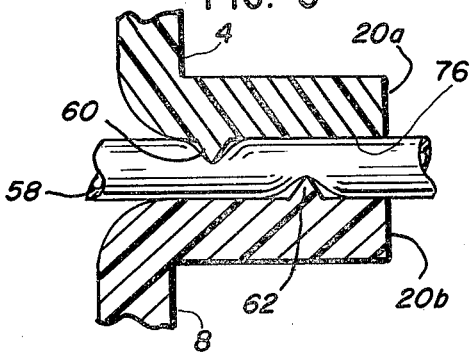

PORTABLE ELECTRIC SINGLE SERVICE BEVERAGE HEATING DEVICE

BACKGROUND OF THE INVENTION

This invention relates to a system for heating a small volume of liquid and more particularly to an immersion heating system used to warm beverages and the like in small containers especially for single servings.

Currently available immersion heaters provide a coil or other standard means for heating a volume of liquid. Typically, the coil or heating element is constructed of a material with electrical resistivity sufficiently high so that the element becomes hot as current passes through it. When immersed in a liquid the energized heating element warms the surrounding liquid. As long as the element is energized, the liquid temperature will continue to increase until boiling and complete evaporation occur. At this point the heating element will often overheat and become permanently nonfunctional. None of the currently available immersion heaters provide protection against this problem.

Furthermore, none of the known immersion heaters provide protection against contact of the heating element with either the user or the surrounding environment. The exposed heating element creates a dangerous condition for the careless consumer which may result in a superficial yet painful burning of the hands. Moreover, the exposed heating element poses a problem in that immediately after use, the consumer must exercise care in the choice of a resting place for the heater as the exposed element may burn the surface on which it is placed. Similarly, currently available immersion heaters that suspend from the edge of the container may burn, disfigure or destroy the interior surface of the container as well.

In addition, most immersion heaters are thermodynamically inefficient insofar as thermal energy transferred to the liquid is lost via the open top of the container. In short, the problem has been to provide an immersion heater that is efficient and yet safe to operate.

OBJECTS OF THE INVENTION

It is an object of the present invention to provide an improved low cost immersion heater system especially adapted for heating a single serving of a beverage or the like.

Another object of the of the present invention is to provide a system which includes an immersion heater constructed and configured to prevent harmful contact with hot elements.

Another object of the present invention is to provide a shrouded immersion heater for consumer use with a control circuit to prevent overheating.

Another object of the present invention is to provide a system including a single service container and an immersion heater that has means for suspension through the center of the single service container to preclude harmful contact therewith.

A further object of the present invention is to provide a thermodynamically efficient immersion heater for consumer use that rapidly distributes the thermal energy created thereby.

Other objects of the invention will become apparent upon reading the following detailed description and upon reference to the drawings.

SUMMARY OF THE INVENTION

This invention was created with the general object of overcoming the disadvantages of prior heaters for consumer or single service use and the further object of providing a system for such use with a high degree of security against unintentional user contact with the heating element.

In a system constructed in accordance with the invention, the heating unit is provided with a heating element, a control circuit, a top portion which serves as a locator and a housing for the control circuit and a bottom portion which serves as a housing and circulator shroud for the heating element and which together comprise a convection pump.

The heating element in the preferred embodiment is encased within a metallic cylindrical cannister and is of a variety currently available. It includes a coil of wire or other material and responds to the flow of electric current therethrough by undergoing a temperature increase. The flow of current through the heating element is regulated by the control circuit.

The control circuit includes, in addition to the heating element, a thermostat which operates at a predetermined temperature to electrically open the circuit and preclude current flow therethrough and a lamp which serves to indicate activation of the system. The thermostatic control is provided to prevent the system from overheating and to cooperate with the shroud and other parts of the system to prevent danger to the system as well as the consumer. In addition, the thermostatic control operates to cause the heating element to energize and deenergize in response to the temperature of the heating element. The responsiveness of the system and system inertia and the control of system hysteresis are optimized by the apertured shroud and overall system design so that the thermal swings and lags are moderated by the rapid circulation of the liquid. The system maintains the temperature of the liquid in a predetermined range.

The heating element and the associated control circuit are enclosed in a unitary plastic housing. The control circuit is enclosed in a top portion and the heating element is enclosed in a lower shroud portion. The housing is constructed with three layers: a top portion of a predetermined radius and thickness, a middle portion with a perimetrical extension of radius greater than the top portion and thickness comparable to the top portion, and a bottom portion of radius and thickness comparable to the top portion. The extension about the middle portion is of a diameter that permits the entire unit to positively engage the upper lip of a beverage container having dimensions within a range of diameters and heights consistent with the housing. This design maintains the central location of the heating element in relation to the container and provides for immersion in sufficient liquid to insure a pumping action.

The heating element and the shroud portion of the housing are connected to and extend downward from the center of the upper portion. The shroud formed of a temperature tolerant thermoplastic material, is hollow, cylindrical and extends completely about the heating element shielding it from contact with external objects. Its diameter is less than the diameter of the smallest part of the top portion. The shroud is apertured to promote the flow of fluid in a path up and into the shroud, around the heating element and out of the shroud to be recirculated.

An important feature of the invention is that the heating element is enclosed to protect against harmful contact therewith. This feature provides enhanced safety in the operation and handling thereof.

It is another important feature of the invention that the same protective shroud cooperates with the heater and container to define relatively narrow vertical convection paths to produce a pump action from the central bottom of the container out through the upper shroud aperture and downwardly between the shroud and inner container wall.

It is still another feature of the invention that the protective shroud lowers the thermal hysteresis by promoting circulating fluid movement which reduces the thermal inertia of the heaters thereby reducing the risk of damage by overheating following use.

Another feature is that of the thermostatic control. In preventing overheating, it increases the useable life of the invention, saves energy and enhances the safety of its operation. In maintaining the temperature of the fluid within a predetermined range close to the internal temperature of the heater it provides an advantageous operation from the standpoint of the consumer in that the liquid will neither boil away nor cool to an unacceptable temperature.

The central location of the heating element is particularly advantageous in that it reduces the possibility of causing thermal damage to the container and allows for a more efficient thermal energy transfer of the fluid.

The invention contemplates other objects, advantages and features which will become more fully apparent from the following detailed description taken in conjunction with the accompanying drawings.

BRIEF DESCRIPTION OF THE DRAWINGS

FIG. 1 is a perspective view of the preferred embodiment;

FIG. 2 is a side elevational view of the preferred embodiment partially in section;

FIG. 3 is a bottom plan view of a portion of the preferred embodiment; and

FIG. 4 is a circuit diagram of the subject invention.

FIG. 5 is an enlarged cross-sectional view taken along the line 5 of FIG. 3 showing the engagement of the assembly with the line cord.

DESCRIPTION OF A PREFERRED EMBODIMENT

A liquid heating system constructed in accordance with the principles of this invention is shown in FIGS. 1, 2 and 3. FIG. 1 depicts a housing 1 constructed according to the invention situated above an appropriate beverage container 2 which is here illustrated as a 10 ounce cup having a bottom 2*a*, cylindrical side walls 2*b*, and a handle or similar gripping portion 2*c*. The system's housing 1 has a disc-shaped top portion 10 and a cylindrical shroud portion 12.

The top portion 10 has three sections: a dome 4, a flange 6 and a hub 8 (FIG. 2). The dome 4 has a flat circular surface 14 supported circumferentially by an edge 16 which extends downwardly from and perpendicular to the surface 14. The flange 6 has an upper surface 18 and a lower surface 24. The edge 16 of the dome 4 perpendicularly joins the upper surface 18 of the flange 6. The flange upper surface 18 is uniformly circular and concentric with the dome surface 14 and radiates in a plane normal to the dome edge 16 to the flange edge 20. Flange edge 20 includes portions 20*a* and 20*b*. Portion 20*a* is integral with surface 18 and dome 4 and portion 20*b* is integral with surface 24 and hub 8. Ridges 66*a* and 66*b* extend upward normal and perimetrical to the interior surface of the flange portion 20*b* and are relatively spaced so as to provide a circumferential channel or groove into which a chemical solvent may be disposed in the process of manufacture. A mating ridge 64 extends downwardly from the flange portion 20*a*. When the housing 1 is assembled, ridge 64 engages a solvent disposed in the channel formed by ridges 66*a* and 66*b*. Thus, flange portions 20*a* and 20*b* are joined at seam 22 sealing the dome 4 to the hub 8 and forming the flange 6. When flange portions 20*a* and 20*b* are joined, a small opening 76 is provided through which the line cord 58 extends. Ribs 60 and 62 are separate from ridges 66*a* and 66*b*. Rib 60 extends downwardly from the interior surface of the flange portion 20*a*. Rib 62 extends upwardly from the flange portion 20*b*. When the unit 1 is assembled, the ribs 60 and 62 engage the line cord 58 thereby transferring tension from the line cord 58 to the top portion 10 of the housing 1. The line cord 58 is terminated on one end by the control circuit 46 (FIG. 4) and on the other by a plug 70.

The flange edge 20 extends downwardly to join at a right angle the flange lower surface 24 (FIGS. 2 and 3). The flange upper surface 18 and lower surface 24 are of dimensions that permit the flange lower surface 24 to rest atop a fluid receptacle such as the 10 ounce beverage container 2. The flange lower surface 24 extends in a plane parallel to flange upper surface 18 and joins the hub 8 at a right angle. Protrusions 26, 28, 30 and 32 extend radially on flange lower 24 and transversely across hub 8 forming a right angle coincidental to the right angle formed at the intersection of the flange lower surface 24 and the hub 8. The protrusions 26, 28, 30 and 32 allow the unit to positively engage the upper edge 2*d* of the beverage container 2 while maintaining the flange lower surface 24 spaced from the lip or edge 2*d* such that a gap is created through which excessive super atmospheric liquid vapor may escape when the system is in operation.

The heating element 34 suspends from the electric center of the top portion 10 and rests on a circular ridge 74. Consequently, when the unit 1 is in place atop an appropriate beverage container 2 the electric heating element 34 is suspended along a central axis extending through the beverage container 2. The protrusions 26, 28, 30, and 32 on the cylindrical hub 8 insure spacing between the edge 8 and the cylindrical wall 2*b* of the beverage container 2.

The shroud 12 functions to shield the electric heating element 34 from contact with external objects and serves as an integral element of the thermodynamic pump to be described. The shroud 12 extends normal to the plane of the undersurface 9 of the hub 8. It is cylindrical in shape with a diameter substantially greater than the diameter of the electric heaing element 34 and less than the diameter of the hub 8. The radial spacing between the shroud 12 and the hub 8 provides an annular fluid space between the shroud 12 and the container wall 2*b* for the purposes described below. It has a length greater than the length of the heating element 34 and preferably but not necessarily less than the length of the associated beverage container 2.

The shroud 12 is perforated with a plurality of holes 36 and 38. In assembling the unit for use the holes 36 and 38. In assembling the unit for use the holes 36 and 38 serve initially to allow the escape of air and the entrance of fluid into the shroud 12; fluid thereby enters the shroud 12 and comes in contact with the heating element 34 transferring thermal energy therefrom.

In addition, the holes 36 and 38 cooperate with the heating element 34 to provide a thermodynamic liquid pumping action whereby hot liquid is forced out of the holes 36 and 38 drawing cold liquid into the shroud 12 via the mouth of the shroud 44. The thermodynamic pump insures against the hazard of the heating element reaching deleterious temperatures by virtue of the inefficient thermal distribution associated with the relatively slow process of heat diffusion or drift or conduction through the fluid. The pumping action forces the liquid to move to the heat instead of allowing it to sit cold until the heat reaches it. The fluid flow is generally circular in motion when viewed in one plane through the cup axis or in the three dimensional sense the motion is toroidal in nature. The hydraulic momentum created by this flow also facilitates the continuous cleaning of the elements. This action operates continuously to provide fast efficient distribution of thermal energy and protects the electric heating element 34. This minimizes the thermal inertia and switching hysteresis in the system.

The system functions with beverage container 2 having a range of heights. If the height of the cylindrical wall 2*b* is such that the shroud 12 rests on the bottom 2*a* the undersurface 24 is spaced from the lip 2*d*. In that case to assure fluid flow into the shroud 12 when the shroud 12 is in abutting relation with the interior surface of the beverage container bottom 2*a*, a plurality of notches 40 and 42 are positioned around the bottom edge of the shroud 12. This facilitates the convective pump action and assures uniform heating of the fluid and minimum thermal hysteresis.

A control circuit 46 (FIG. 4) is provided to regulate the operation of the system. It has one branch 56 consisting of the series connection between the electric heating element 34 and a thermostat 48, in parallel with another branch 54 consisting of a lamp 50 and a resistor 52. The parallel relationship between the indicator lamp 50 and the electric heating element 34 permits the lamp 50 to indicate that the unit is energized even though the heating element 34 may be held in an off condition by the thermostat 48. The lamp 50 is circumferentially secured within an elongated open-ended tubular socket 68 which extends upward normal to the plane of the hub undersurface 9 as shown in FIG. 2. The dome 4 is molded in a transparent thermoplastic material in the preferred embodiment so that energization of the lamp 50 is readily ascertainable externally. In a preferred embodiment the mold in which the dome 4 is formed has the surface 14 or the corresponding inner surface 15 treated with a reticulation to render that surface translucent and thus obscure the internal parts other than a circular area 72 directly above the lamp 50.

The thermostat 48 will operate to deenergize the electric heating element 34 whenever the electric heating element 34 exceeds a predetermined temperature. Because of the thermal pumping action, the electric heating element 34 will normally not heat to a temperature where thermostat 48 opens the branch 56 until the liquid approaches the operating temperature (normally 212° F.). As the fluid temperature approaches a uniform optimum temperature, the thermostat 48 will cycle so that the liquid at the walls of container 2 will be maintained a few degrees below boiling while boiling occurs at the electric heating element 34. The system will recycle in that the thermostat 48 will close the circuit and reenergize the electric heating 34 whenever the system's temperature drops below a prescribed value. If the liquid boils away, the thermostat will go on infrequently for short periods without excessive heat being transferred to the shroud or housing due to the much higher thermal inertia in the dry state. The load resistor 52 is included to make the branch 54 electrically compatible with the lamp 50 which may be gas filled with a gas such as neon.

To operate the system, the unit 1 is placed into a beverage container 2 filled near capacity with liquid and plugged into a nearby electrical outlet. The indicator lamp 50 will remain lit so long as the unit is plugged in.

The unique combination of this invention has correlated heater size, shroud size, shroud apertures, thermal output of the heating coil, thermostat hysteresis and the other design parameters discussed herein to produce a safe, manipulatable single service consumer product for heating water and the like. The system provides rapid fluid pumping as heat concentrates near the heater and the heat is thus carried away to enhance thermal coupling from the heater to the entire fluid body. The thermal inertia is thus minimized when the system contains liquid. By minimizing the thermal inertia a thermostat with a lower cutoff temperature can be employed whereby the unit, when it is removed from the fluid, after use, will have less retained heat and reduces dry overheating. This facilitates handling and also minimizes damage to the parts, especially the plastic parts, resulting from stored thermal energy in the heater.

In the preferred embodiment, the system is designed for use with 110 volt alternating current and a 10 ounce beverage cup. However, the system may be adapted for 12 as well as 220 volt use and can be used with a wide variety of container sizes and shapes provided they satisfy the desiderata and parameters set forth in this specification. All such containers are intended to be defined by the term "single serving container" or "single service container".

What is claimed is:

1. A portable liquid heating system comprising a single service beverage container having a bottom and side wall and a removable heating unit, said heating unit comprising: housing means having a central axis and a radially extending imperforate annular flange means sufficiently wide relative to said beverage container for support on the side wall thereof, said flange means including means extending therefrom along the underside thereof maintaining said flange in spaced relationship from said side wall for venting said container; rigid, apertured shroud means having one end secured to said housing means and extending along said central axis from said flange means into said container and spacer means extending from said flange means generally surrounding said shroud means adjacent said flange means and engageable with said side wall to maintain a generally annular space between said shroud means and said side wall; cylindrical resistance heating means suspended by one end from said housing means and extending along said central axis in a spaced relationship to said shroud means; and a thermostat within said shroud means in direct thermal association with said resistance heating means, responsive to the temperature of the resistance heating means, and controlling the temperature of said resistance heating means, said shroud means being apertured at predetermined locations along its length to pass heated liquid located between said heating means and said shroud means to a location between said shroud means and said side wall whereby convective liquid flow occurs upwardly between said heating means and shroud means and downwardly between said side wall and shroud means, thereby enhancing thermal distribution throughout the liquid and the heating means and enhancing the responsiveness of said thermostat, said shroud means being non-metallic and extending along said central axis with the free end thereof being open to freely pass liquid and extending beyond the end of said resistance heating means to shield said resistance heating means from contact with foreign objects whereby said housing means, including said free end of said shroud means, may rest on such foreign objects without deleterious effects.

2. The liquid heating system of claim 1 wherein said spacer means comprises hub means surrounding said shroud means and disposed within said side wall to provide an annular space between said shroud means and said side wall whereby said shroud means defines interior surfaces and said side wall defines exterior surfaces of said downward liquid path.

3. The liquid heating system of claim 2 wherein the inner surface of said shroud means is cylindrical to define an annular upward liquid path between said heating means and said shroud means.

4. The liquid heating system of claim 1 wherein said flange means comprises mating upper and lower portions, each portion having at least one protrusion advantageously formed on a surface thereof to securely engage an electrical supply line extending through said housing means to said resistance heating means when said portions are joined in assembled relation.

5. The liquid heating system of claim 1 wherein said housing means has a planar top surface to permit said housing means to rest in an inverted position on said upper surface.

6. The liquid heating system of claim 1 wherein said shroud means has notches around the free edge thereof to facilitate the flow of liquid into said shroud means.

7. The liquid heating system of claim 1 including indicator means in circuit with said heating means and thermostat for indicating when said heating means is energized.

8. The liquid heating system of claim 7 wherein said housing means is constructed of a translucent material whereby said indicator means is enclosed within said housing means and yet capable of providing an indication when energized which is visible from the exterior of said housing means.

* * * * *

UNITED STATES PATENT AND TRADEMARK OFFICE

CERTIFICATE OF CORRECTION

PATENT NO. 4,238,666
DATED December 9, 1980
INVENTOR(S) William R. Pomper

It is certified that error appears in the above-identified patent and that said Letters Patent are hereby corrected as shown below:

Column 1, line 50, cancel "of the" (second occurrence)

Column 3, line 29, "of" should be --to--

Column 4, lines 66, 67, cancel "In assembling the unit for use the holes 36 and 38."

Signed and Sealed this

Thirtieth Day of June 1981

[SEAL]

Attest:

RENE D. TEGTMEYER

Attesting Officer

Acting Commissioner of Patents and Trademarks